US005618250A

United States Patent [19]

Butz

[11] Patent Number: 5,618,250

[45] Date of Patent: Apr. 8, 1997

[54] AEROBIC EXERCISE MACHINE TARGETING TRUNK MUSCLES

[76] Inventor: Todd M. Butz, 1984 Marietta- Mt. Joy Pike, Marietta, Pa. 17547

[21] Appl. No.: 300,294

[22] Filed: Sep. 2, 1994

[51] Int. Cl.[6] ..... A63B 21/005; A63B 22/00; A63B 23/02

[52] U.S. Cl. ..... 482/137; 482/5; 482/8; 482/134; 482/903

[58] Field of Search ..... 482/5, 8, 137, 482/139, 903, 134; 601/23

[56] References Cited

U.S. PATENT DOCUMENTS

| | | | |
|---|---|---|---|
| 2,152,431 | 3/1939 | Jensen . | |
| 3,767,190 | 10/1973 | Biggerstaff . | |
| 4,408,759 | 10/1983 | Reneau et al. | 482/138 |
| 4,462,252 | 7/1984 | Smidt et al. | 482/137 |
| 4,635,933 | 1/1987 | Schnell | 482/137 |
| 4,725,056 | 2/1988 | Rehrl et al. | 482/139 |
| 4,730,829 | 3/1988 | Carlson | 482/908 |
| 4,746,806 | 5/1988 | Campagnuolo et al. | 482/903 |
| 4,844,054 | 7/1989 | Raemdonck . | |
| 4,854,578 | 8/1989 | Fulks | 482/137 |
| 4,893,811 | 1/1990 | Dilmore | 482/5 |
| 5,020,795 | 6/1991 | Airy et al. | 482/5 |
| 5,035,234 | 7/1991 | Forsythe . | |
| 5,062,633 | 11/1991 | Engel et al. | 482/139 |
| 5,070,863 | 12/1991 | McArthur et al. . | |
| 5,098,089 | 3/1992 | Harrington et al. . | |
| 5,110,121 | 5/1992 | Foster . | |
| 5,178,597 | 1/1993 | Jones . | |
| 5,195,935 | 3/1993 | Fencel | 482/70 |
| 5,205,801 | 4/1993 | Haner | 482/63 |
| 5,215,511 | 6/1993 | Cheng . | |
| 5,224,909 | 7/1993 | Hamilton . | |
| 5,232,425 | 8/1993 | Miller et al. . | |
| 5,242,179 | 9/1993 | Beddome et al. | 482/62 |
| 5,256,126 | 10/1993 | Grotstein . | |
| 5,324,247 | 6/1994 | Lepley | 482/137 |
| 5,409,435 | 4/1995 | Daniels | 482/5 |
| 5,433,678 | 7/1995 | Chi | 482/903 |

OTHER PUBLICATIONS

*Health Rider,* The Total Body Fitness Machine advertisement on video box avail. on or before Sep. 1993.
MAXICAM by Muscle Dynamics, Back & Abdominals, 2 pages.
Nautilus brochure.
Nautilus For Women Product Line, brochure.
Nautilus, Making America Stronger brochure.
Universal, A New Look, A New Feel, 2 pages of brochure.
Medx Corporation, Torso Flexion Machine flier.
Medx Corporation, Hip Extension Machine flier.
Cybex, Eagle Fitness Systems, pp. 20 & 21 of brochure & front of brochure.
Universal, Merac Back Flexion/Extension System flier.
Universal, When You're Serious About Fitness brochure pp. Cover, 21 & 22.
Life Fitness, Smart Solutions from the Industry Leader brochure, front & back & page showing abdominal & back extension.
Biodex Corporation, brochure, 1987, 482/5, 8 pages.
*Crank–Type Exerciser Provides Resistance,* Reneau, Relyea & Associates, Inc., description in The Sporting Goods Dealer, Jun. 1980, p. 122, 482/137.

*Primary Examiner*—Stephen R. Crow
*Assistant Examiner*—Victor K. Hwang
*Attorney, Agent, or Firm*—Michael F. Petock, Esq.

[57] ABSTRACT

An aerobic exercise machine is disclosed in which aerobic exercise may be conducted using the trunk and hip flexor and extensor muscles. The exercise machine does not require dynamic use of the extremities. The exercise machine provides a uniform level of resistance to contact means adapted to contact both the anterior and posterior surfaces of the trunk of the person exercising. The exercise machine enables exercise by flexion and extension of the trunk muscles and flexion and extension of muscles controlling the hip joint. An energy storage device is utilized to provide uniform resistance to movement in both directions and during the reversal of directions. A counter is provided and various levels of resistance may be selected by switching selected amounts of resistance across the output of a generator driven by the motion of the exerciser.

24 Claims, 5 Drawing Sheets

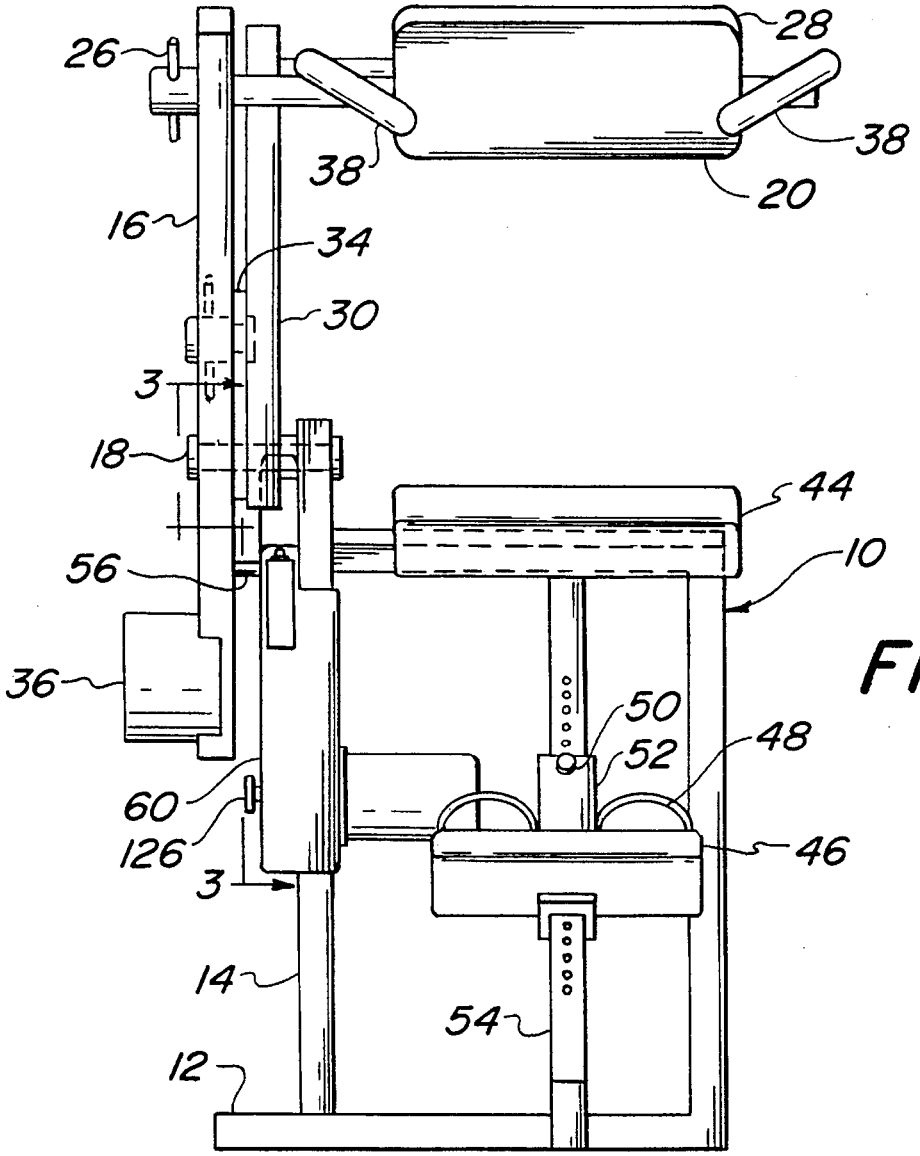
FIG. 2
FIG. 6
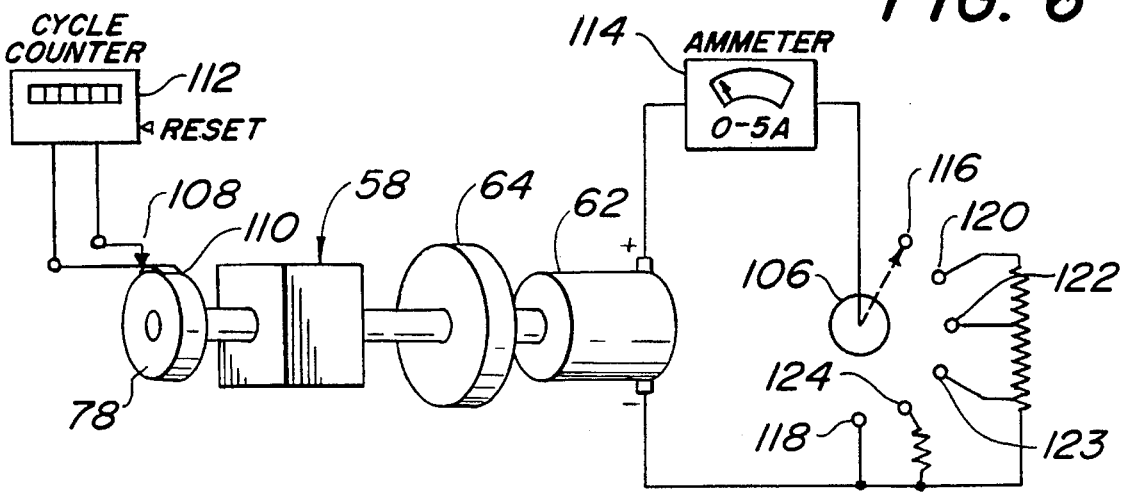

AEROBIC EXERCISE MACHINE TARGETING TRUNK MUSCLES

FIELD OF THE INVENTION

The present invention is directed to the field of exercise machines, and particularly aerobic exercise machines for primarily exercising the trunk muscles.

BACKGROUND OF THE INVENTION

The human body has two main biochemical pathways of "burning" fuel to supply energy for the performance of work. One of these pathways, referred to as aerobic metabolism, utilizes oxygen to produce energy whereas anaerobic metabolism does not utilize oxygen. Aerobic exercise, which requires the transport of large amounts of oxygen is believed to have beneficial effects on the cardiovascular system and is sometimes also referred to as cardiovascular exercise. Activities such as jogging, cycling, swimming, rowing and cross country skiing are generally identified as aerobic exercises and primarily involve the use of the muscles of the extremities, that is the arms and legs. Anaerobic exercise is sometimes referred to as resistance exercise and includes weight lifting and sprinting. Aerobic exercise is usually of moderate intensity, perhaps 60–80% of maximum exertion, is generally believed to require an extended duration of at least 15 or 20 minutes and burns primarily fat (fatty acids) for fuel. Aerobic exercise is believed to improve endurance, decrease blood pressure and body mass and improve the lipid profile and insulin sensitivity. On the other hand, anaerobic exercise requires maximum intensity usually in the 80–100% of the possible intensity range, is usually performed in seconds to minutes, and utilizes primarily sugar and glycogen stores for fuel. Anaerobic exercise tends to increase both body strength and size.

Known forms of aerobic exercise machines include treadmills, exercise cycles, stair steppers, rowers, cross country skiers and arm ergometer (arm cycles) which exercise primarily the muscles of the legs and arms. Known weight training machines for anaerobic exercise use weights, elastic bands, springs and pressurized canisters which in most cases exercise the extremities. However, a few resistance or anaerobic machines do provide unidirectional resistance training for either the abdominal or back muscles, such as the abdominal machines and back extension machines manufactured and marketed by Nautilus, Cybex, Universal and Life Fitness as well as some other exercise equipment companies. Several flexor or extensor chairs or machines have also been patented including those shown and described in U.S. Pat. Nos. 3,767,190-Biggerstaff; 5,110,121-Foster and 5,215,511-Cheng. However, none of the prior art has taught nor suggested an aerobic exercise machine which provides a substantial uniform resistance on both the flexion and extension portions of the cycle utilizing an aerobic level of resistance.

SUMMARY OF THE INVENTION

The present invention provides a number of significant advantages including the providing of an aerobic exercise machine which targets the trunk muscles (abdominals, hip flexors, low back and gluteal muscles) as the primary exercising muscles.

The present invention further provides an exercise machine which couples both trunk flexion and extension in a cyclical, "to and fro" motion.

The present invention further provides an aerobic exercise machine for exercising the trunk muscles which requires the exerciser to exert a positive effort in both the flexion and extension phases of the motion, in other words half of the cycle is not a passive recoil movement.

The present invention further provides an aerobic exercise machine that isolates the hip joint as the fulcrum for the body motion and effectively combines flexion exercise and extension exercise into a single aerobic exercise.

The present invention provides the further advantage that it provides an aerobic exercise machine which does not require dynamic motion of either the arms or legs. Only the hip joints and the spine are the points of movement. The present invention provides an exercise machine that provides a new and different form of aerobic activity and one that does not require a great demand on the extremities. The present invention reduces wear and the possibility of injury to the joints of the extremities and particularly the knee joint which often becomes a source of impairment as a result of an accident or extended aerobic activity of the type previously available. The present invention further provides a distinct advantage not only to those with preexisting injuries, but also for overweight individuals where a "low impact" form of aerobic activity may be highly desirable. However, a low impact form of aerobic activity is usually considered desirable for all, including those who are not overweight.

Further, the present invention provides an aerobic exercise machine that couples the isolated movement of the hip joints and spine to an energy storage device which may be in the form of a flywheel mechanism. The energy storage device may be utilized advantageously to compensate for the force of gravity and allows for a more evenly distributed work load throughout the flexion and extension cycle. The present invention, through the energy storage device, provides for a smooth pass throughout the flexion and extension cycle, including the transition from flexion to extension and vice versa.

The present invention provides advantages in that it provides an aerobic exercise machine that will allow for the testing of possible "spot" fat reduction by means of targeted aerobic exercise, provides a machine to allow for the testing of trunk muscle aerobic activity and its impact on body composition (i.e. lean body mass and percent of body fat) and provides a machine which allows for the testing of trunk muscle aerobic activity and its impact on body shape and form as compared to its impact on body composition. Further, the present invention provides an aerobic exercise machine that allows for the testing of the efficacy of using aerobic exercise of the trunk muscles, which was previously unavailable, in the prevention and treatment of Low Back Pain Syndrome.

Briefly and basically, in accordance with the present invention, an exercise machine is provided which includes means for contacting the anterior surface of the trunk of a person and means for contacting the posterior surface of the trunk of a person. A means for providing a substantially uniform resistance to movement of the contact means in both the anterior and posterior directions to enable aerobic type exercise primarily of the trunk and hip flexor and extensor muscles is provided thereby providing a substantially uniform resistance to flexion in the anterior direction and to extension in the posterior direction, and during the reversal of direction.

BRIEF DESCRIPTION OF THE DRAWINGS

For the purpose of illustrating the invention, there are shown in the drawings forms which are presently preferred;

it being understood, however, that this invention is not limited to the precise arrangements and instrumentalities shown.

FIG. 2 is a front elevation view of the aerobic exercise machine shown in FIG. 1.

FIG. 6 is a schematic diagram of the circuitry of the present invention.

DETAILED DESCRIPTION OF THE PREFERRED EMBODIMENTS

Figure 1:
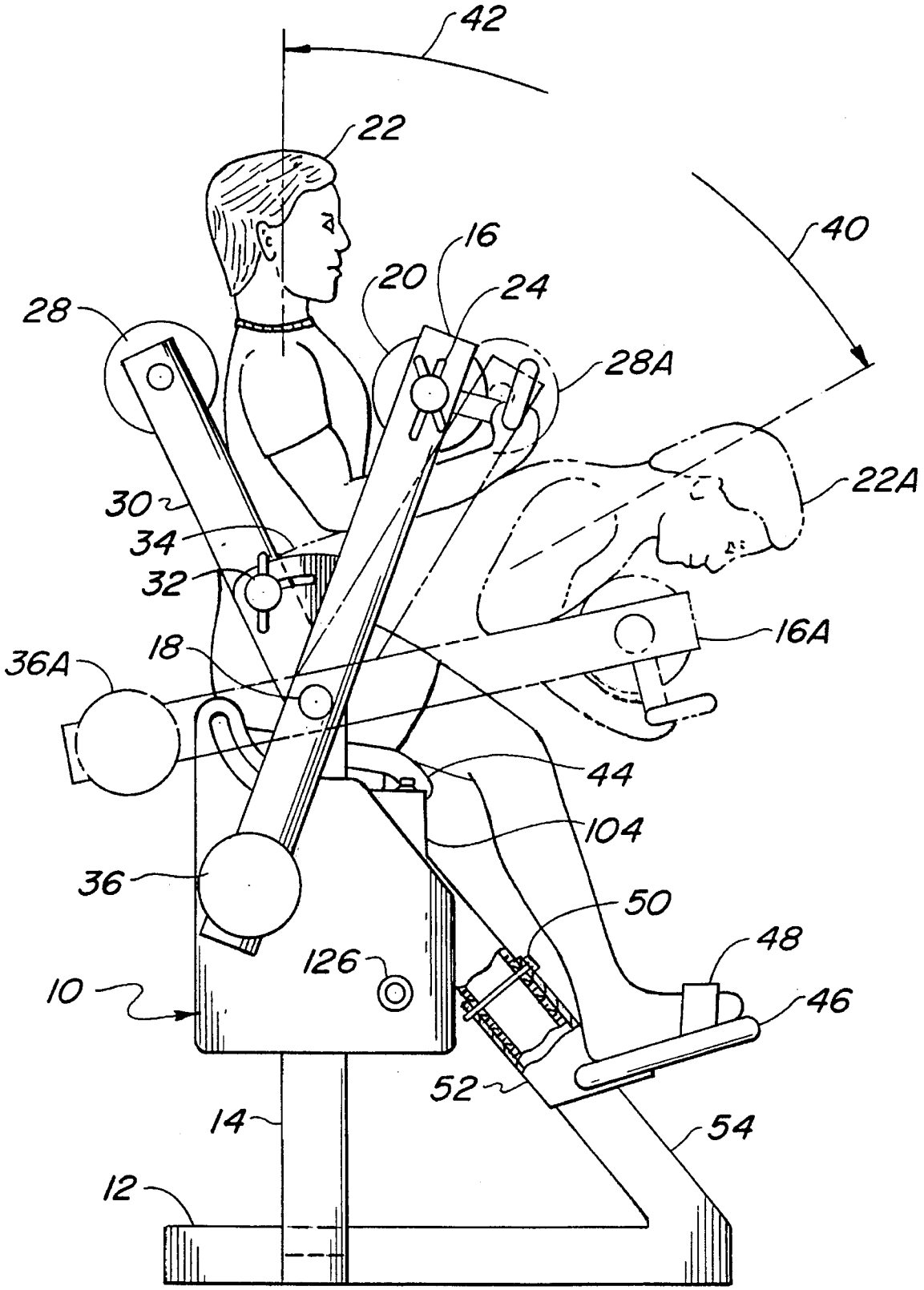
FIG. 1 is a side elevation view of an aerobic exercise machine in accordance with the present invention, illustrating a second position of the moveable arm in dotted outline.

Referring now to the drawings, wherein like numerals indicate like elements, there is shown in FIGS. 1 and 2 an aerobic exercise machine 10 in accordance with a presently preferred embodiment of the invention. Aerobic exercise machine 10 is provided with a base 12 and a vertical support member 14. A moveable arm 16 is pivotally mounted to vertical support member 14 at 18. Moveable arm 16 has a chest or upper anterior trunk contact member or pad 20. The support bar for pad 20 for contacting the anterior surface of the trunk of a person 22 is adjustable by means of slot 24 in arm 16. The adjustment of the position of pad 20 is maintained by tightening the threaded locking handle 26. A second contact member or pad 28 engages the posterior surface of the trunk of the exerciser 22 or in other words the back of the exerciser. The position of the contact member or pad 28 with respect to the trunk of the person is adjustable by adjusting arm segment 30 which also pivots at pivotal mount 18 and is locked to and may be considered to form a part of arm 16 by reason of its locking adjustment 32 on segment flange 34. Segment flange 34 is fixed to movable arm 16. Arm 16 is provided with a counter weight 36. The anterior trunk contact pad or chest pad 20 is provided with handles 38.

FIG. 1 also illustrates in dotted outline the exerciser 22A with his trunk in flexion or in other words moved anteriorly in the direction of arrow 40. Moving in a posterior direction would be in the direction of arrow 42.

As may be seen, the exerciser 22 is provided with a seat 44 which, in addition to supporting the exerciser, also resists movement of the hip during the flexion and extension exercises. The exerciser 22 is provided with a foot rest 46 which is provided with straps 48 and an adjustment 50 to compensate for exercisers having differing leg lengths. Although the adjustment 50 is shown as a sleeve 52 over an incline support 54 with a pin passing through holes in both, it will be apparent to those skilled in the art that various other structures may be utilized for this adjustment including various friction locks and arrangements where mating gears or detents may be utilized.

As may be best seen in FIG. 1, contact means 20 contacts the anterior surface of the trunk of exerciser 22, preferable in the area of the chest, although it may be slightly higher or lower. Contact means 28 contacts the posterior surface of the trunk of a person which may preferably be the upper back, although that may be higher or lower. Various contact means may be utilized, but it is presently preferred that rounded pads be utilized. However, it is understood that various other types of pads or structures may be utilized to contact the anterior and posterior surfaces of the trunk of the exerciser. Preferable, adjustment 32 is made so that there is minimal or no free space between the user and the anterior and posterior contact pads.

As may be seen, by providing a uniform resistance to arm 16, to which arm 30 is fixably coupled and may be considered to be a part of, the exerciser 22 will have a uniform resistance on both flexion and extension of the trunk and hip. On flexion, when the exerciser moves in the direction of arrow 40, the primary muscle used in trunk flexion is the rectus abdominis and the secondary muscles used are the internal and external obliques. With hip flexion, the primary muscles used are the psoas major and the iliacus and the secondary muscles used are the rectus femoris, sartorius, tensor fasciae latae, pectineus, adductor brevis, longus and magnus (oblique fibers). On extension, or movement posteriorly in the direction of arrow 42, the primary trunk extension muscles used are the erector spinae-iliocostalis thoracis, longissimus thoracis, spinalis thoracis, and iliocostalis lumborum along with the secondary muscles of semispinales, multifidus and rotatores. The primary hip extension muscles are the gluteus maximus, semitendinosus, semimembranosus and the biceps femoris (long head).

Arm 16 is connected to a means for providing a substantially uniform resistance to movement by means of a connecting pin 56 located below pivot 18 as may be best seen in FIGS. 2, 4 and 5. However, it will be understood by those skilled in the art that various other arrangements and connections may be made to provide a uniform resistance to movement by contact members 20 and 28. Not only may the structure of the pin or connection be different, but the connection could also be made above the pivot point or the pivot point constructed lower. Nevertheless, in a presently preferred embodiment, the structure is as illustrated in the drawings. The structure of the means of providing the substantially uniform resistance to movement of the contact means in both the anterior and posterior directions will be described herein with respect to the preferred embodiment illustrated in the drawings, but it is understood that various other arrangements of drive means and resistance may be utilized in practicing the present invention.

Figure 3:
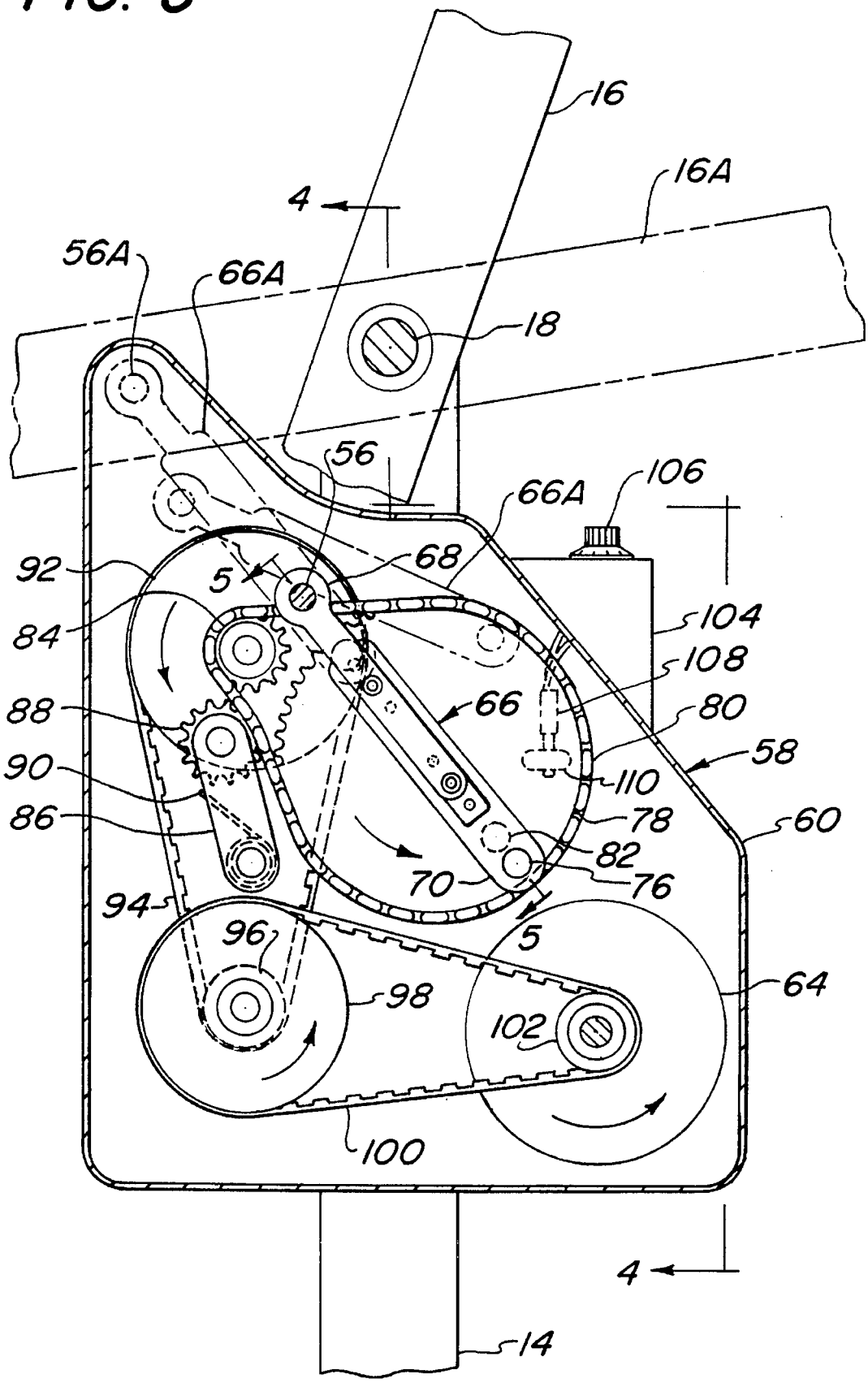
FIG. 3 is a broken away view primarily of the drive assembly taken along line 3—3 of FIG. 2.
Figure 4:
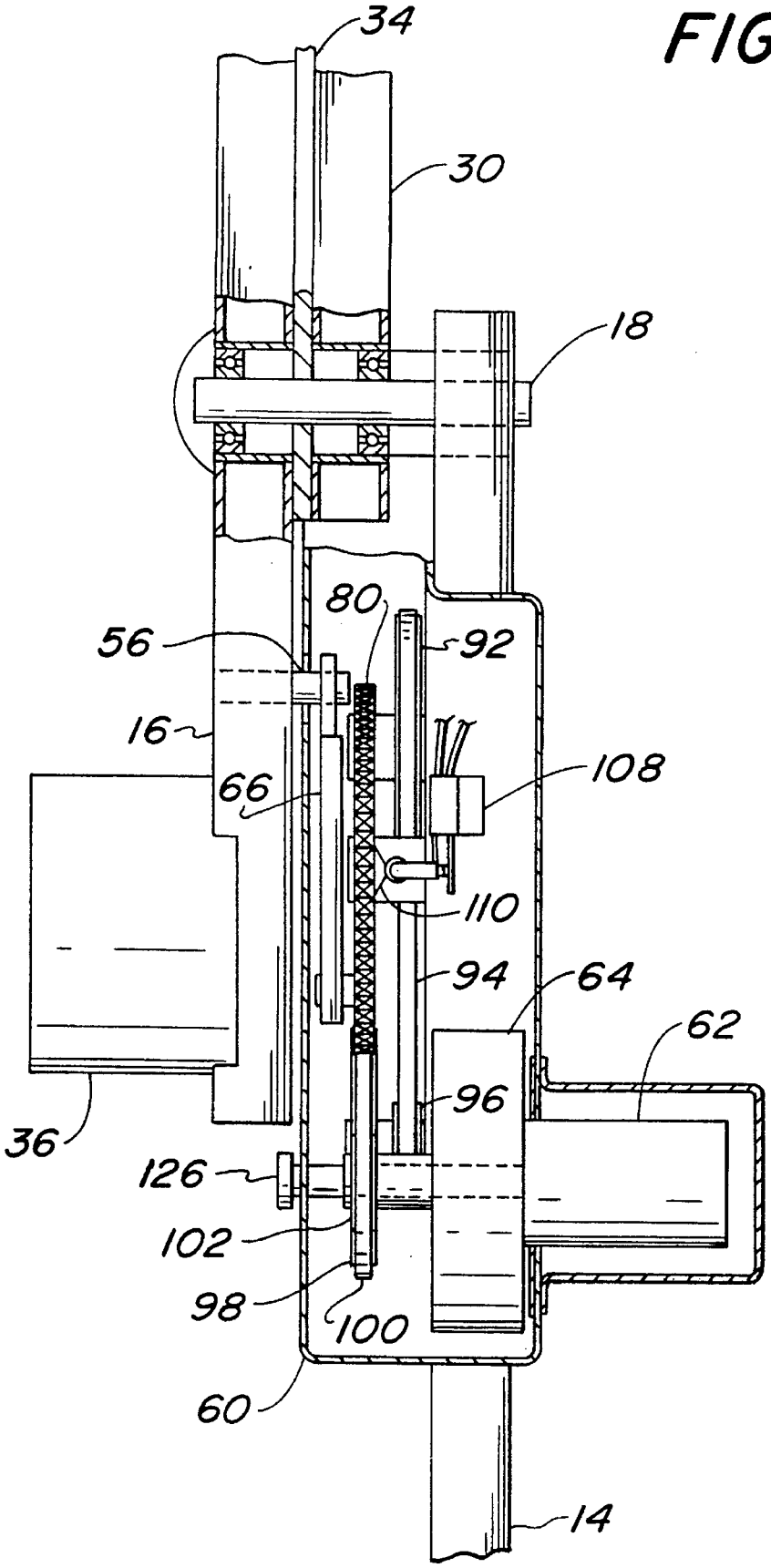
FIG. 4 is a partially broken away view, partially in cross section, taken along line 4—4 of FIG. 3.
Figure 5:
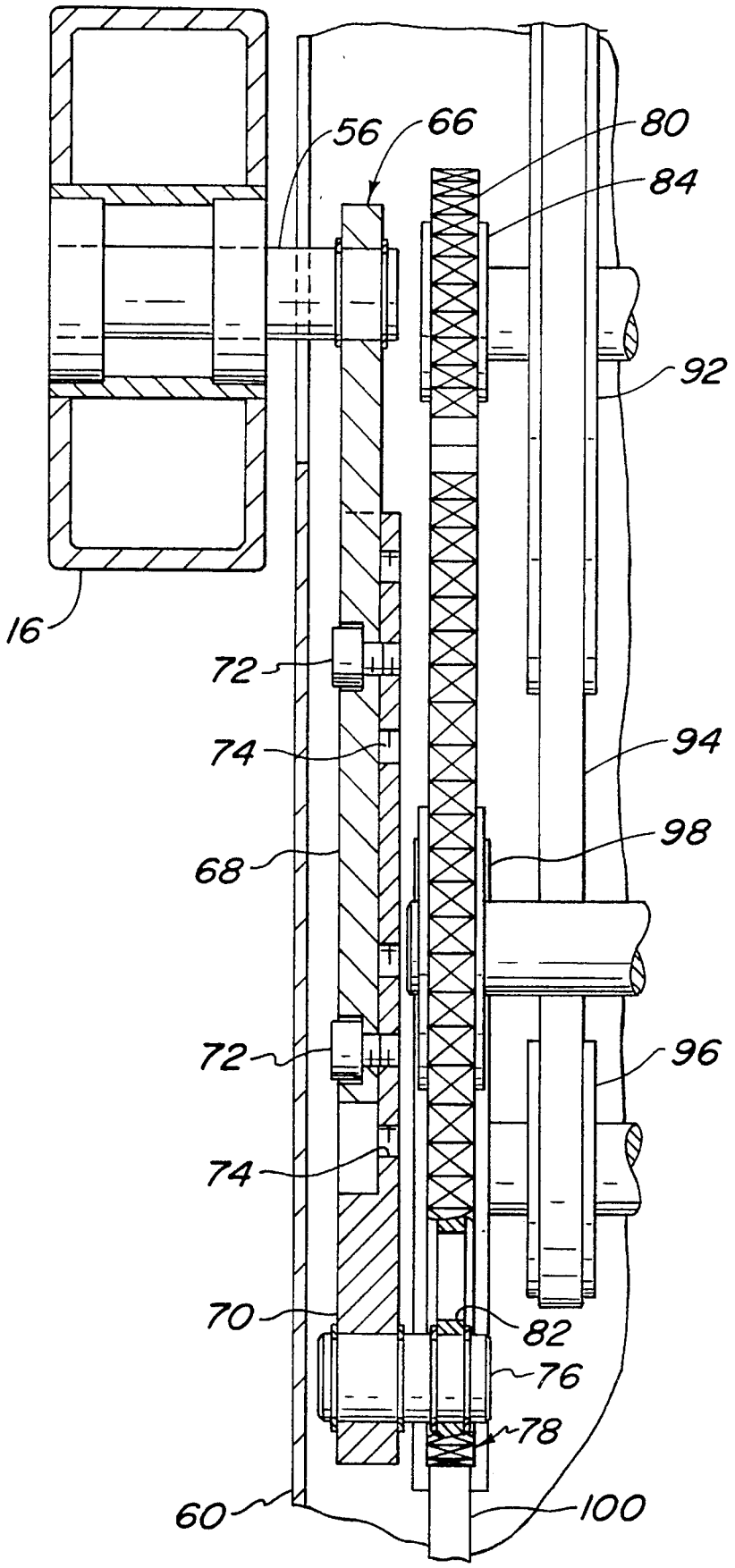
FIG. 5 is a broken away view, partially in cross section, taken along line 5—5 of FIG. 3.

Pin 56 provides a connection and forms a part of a drive assembly 58 which may be best seen in FIGS. 3, 4 and 5. Drive assembly 58 is enclosed within a housing 60. Drive assembly 58 speeds up or increases the rate of movement of moveable arm 16 to enable it to drive a DC generator 62 at an RPM (revolutions per minute) sufficient to generate a current in a desired range, which in the presently preferred embodiment is between 0 and 5 amperes. The DC generator is provided with a permanent magnet. DC generator 62 is provided with a flywheel 64 of a size sufficient to act as an energy storage device to provide a smoothing or uniformity of the resistance throughout the range of extension and flexion, including the reversal from extension to flexion and vice versa during use of the machine. In the presently preferred embodiment, the flywheel 64 has a diameter of about 6 inches, but it is understood that other suitable sizes of flywheels may be used and that other types of energy storage devices may be used.

Referring to the drawings, and particularly as may be best seen in FIGS. 3, 4 and 5, movable arm 16 is connected by means of pin 56 to an adjustable connecting rod 66. It will be understood by those skilled in the art that the connecting rod need not be adjustable as a single selected length of connecting rod may be utilized. In the presently preferred embodiment, connecting rod 66 is comprised of two elements, 68 and 70 which may be mounted together by threaded fasteners to provide a variation in length, and accordingly a variation in the angle of movement of moveable arm 16. The connecting rod fasteners are shown as 72 with alternate threaded holes 74 in element 70.

The other end of adjustable connecting rod 66 is journaled by means of pin 76 to chain sprocket 78 which carries chain 80. Chain sprocket 78 is provided with a second hole 82 for receiving pin 76 to provide another adjustment if so desired.

Chain 80 drives sprocket 84. FIG. 3 also illustrates in phantom two other positions of chain sprocket 78 and connecting rod 66. A second position of moveable arm 16 is shown as 16A in phantom. Adjustable connecting rod 66, chain sprocket 78, chain 80 and sprocket 84 may be referred to as the first stage drive. Chain 80 is provided with a spring loaded idler arm 86 which eliminates or reduces any slack in chain 80 and provides smooth operation, particularly at the times when movable arm 16 is reversing from an anteriorly moving direction in the direction of arrow 40 to a posteriorly moving direction in the direction of arrow 42 and vice versa. Idler arm 86 is provided with a sprocket 88 which rides in chain 80 and a spring 90 for maintaining tension on the arm.

Pulley 92 is secured to and rotates with sprocket 84. Pulley 92 carries a belt 94 which drives pulley 96. Pulleys 92 and 96 and belt 94 may be referred to as the second stage drive.

Pulley 96 is secured to and rotates with pulley 98. Pulley 98 carries belt 100 which drives pulley 102. Pulleys 98 and 102 and belt 100 may be referred to as the third stage drive. Pulley 102 is secured to and rotates with both flywheel 64 and the rotating armature (rotor) of generator 62.

The direction of rotation of the chain sprocket and pulleys 92, 98 and flywheel 64 are indicated by the arrows shown on those elements for rotation in one direction. However, the mechanical structure may rotate in either direction, the only difference being that the output of the DC generator 62 would be reversed. It is further understood that various modifications may be made to this structure. Particularly, all of the drives could be chain or belt drives or any combination of these arrangements. Furthermore, a gear drive could be utilized in place of chains and belts. Other types of friction drives could also be utilized. Various other structures may be utilized for converting the relatively slow reciprocating movement of moveable arm 16 to a higher speed movement for suitable rotation of a generator (i.e. a cyclical resistance device) with a suitable type of energy storage device to provide smooth, uniform resistance on arm 16 both in the forward (anterior) and rearward (posterior) directions, including the transition points where directions are reversed. As will be apparent to those skilled in the art, that diameters of the drive sprockets or pulleys need to be larger than the diameters of the driven sprockets or pulleys to produce the desired increase in speed of rotation.

As may be best seen in FIGS. 1, 2 and 4, a knob 126 is provided on an extension of the shaft of flywheel 64 and generator 62. Knob 126 may be manually turned to rotate flywheel 64, generator 62, as well as the remainder of the drive assembly with the coupled arm 16. Knob 126 is provided as an aid in starting the movement of arm 16 when it is located at one of its extremes, or in other words when connecting rod 66 is in line with the diameter of chain sprocket 78. Accordingly the turning of knob 126 may be utilized to place the adjustable connecting rod 66 and its associated pins 56 and 76 slightly off of dead center.

FIGS. 1 and 3 show certain elements in phantom in differing or moved positions, and these elements are numbered with the same number followed with an "A".

Referring now to all of the figures and particularly including the schematic diagram of FIG. 6, the first stage drive is provided with a means for providing a count of the number of complete cyclical movements of moveable arm 16. The counter may be located anywhere on the machine, but is preferably located in a location visible to the user from his seated position. The counter in the presently preferred embodiment is located in the electric control and display box 104 which is mounted thereon a rotatable switch 106 for adjusting the level of resistance to movement of movable arm 16. In the presently preferred embodiment, a microswitch 108 is activated by a cam or projection 110 on chain sprocket 78 for each revolution of chain sprocket 78, which corresponds to one complete cycle of moveable arm 16. This arrangement is shown schematically in FIG. 6 which includes the display unit 112 of the cycle counter with its reset.

Also shown in FIG. 6 is a box which represents the remainder of the drive assembly 58 which drives flywheel 64 and DC generator 62. The output of DC generator 62 is supplied to an ammeter 114 which provides a reading of the current output of DC generator 62. DC generator 62 and ammeter 114 are connected in series with switch 106. Switch 106 provides a number of selections to determine the range of difficulty or resistance which is provided by moveable arm 16 to the exerciser. In the presently preferred embodiment illustrated, the switch may be placed on the first position 116 which presents an open circuit to the generator and effectively infinite resistance. Position 116 would represent the easiest setting or the one providing the least resistance force to arm 16. In the last position, switch 106 is connected to contact 118 placing a short circuit across the output of DC generator 62 and provides maximum resistance force to arm 16. The remaining positions of switch 106 represent intermediate amounts of electrical resistance generating intermediate amounts of resistive force. In general, as the electrical resistance increases the current decreases and operation of arm 16 becomes easier or provides less resistance to the exerciser. In the presently preferred embodiment, position 120 would represent five ohms of resistance, position 122 would represent 2½ ohms of resistance, position 123 would represent 1 ohm of resistance and position 124 would represent a half ohm of resistance. It will be apparent to those skilled in the art that various other levels of resistance may be utilized, other current ranges may be utilized, and generators of other suitable capacities may be utilized. Furthermore, although an ammeter has been utilized, it will be apparent to those skilled in the art that a volt meter could be utilized by placing its connections across a suitable resistance, which effectively would measure the amount of current passing through the resistor. Other structure may also be utilized to produce an aerobic level of resistance. With respect to a counter mechanism, various other types of counters may be utilized including mechanical counters, although an electric or electronic counter is presently preferred. It will be apparent to those skilled in the art that various other types of switches or means may be utilized for detecting the revolutions of the sprocket chain including the use of a magnetic red switch wherein a permanent magnet may be mounted on the chain sprocket in place of the cam. Alternatively, a photocell detector may be utilized, for example, a hole may be placed in the chain sprocket with a light mounted on one side and the photodetector on the opposite side.

In view of the above, the present invention may be embodied in other specific forms without departing from the spirit or essential attributes thereof and, accordingly, reference should be made to the appended claims, rather than to the foregoing specification as indicating the scope of the invention.

I claim:

1. An exercise machine, comprising:

a seat;

means for contacting an anterior surface of a trunk of a person:

means for contacting a posterior surface of the trunk of the person; and means for allowing the person to flex and extend the person's body about the person's hip joint, said last mentioned means including an arm pivotally mounted in the region of said seat with said means for contacting an anterior surface and said means for contacting a posterior surface mounted to said arm;

means for providing a substantially uniform resistance to movement of said trunk anterior and posterior contact means in both an anterior and posterior direction to enable aerobic type exercise primarily of trunk and hip flexor and extensor muscles, said means for providing a substantially uniform resistance to movement including a cyclical resistance device and an energy storage device for storing and releasing energy, said pivotally mounted arm being mechanically coupled to said cyclical resistive device and said energy storage device, said energy storage device storing energy when said pivotally mounted arm is moved in one direction and releasing energy as the pivotally mounted arm changes direction to move in an opposite direction.

2. An exercise machine in accordance with claim 1 wherein said energy storage device is a flywheel.

3. An exercise machine in accordance with claim 1 including a counter for counting cycles of movement in the anterior and posterior directions.

4. An exercise machine in accordance with claim 1 including means for selecting a level of substantially uniform resistance to movement.

5. An exercise machine in accordance with claim 4 including a generator with means for selecting various predetermined amounts of resistance to be connected across said generator.

6. An exercise machine in accordance with claim 1 including means for adjusting relative position of said means for contacting the anterior surface of the trunk and said means for contacting the posterior surface of the trunk so that the means for contacting the anterior surface of the trunk is substantially in contact with a chest of the person and said means for contacting the posterior surface of the trunk of the person is simultaneously substantially in contact with an upper back of the person.

7. An aerobic exercise machine, comprising:

a seat;

a moveable arm member having means for contacting a chest and means for contacting an upper back of a person utilizing the machine;

said moveable arm member being pivotally mounted in an area of said seat;

means for providing an aerobic level of resistance to said moveable arm member on both a forward and a reverse movement of said moveable arm member to enable aerobic exercise of trunk and hip flexor and extensor muscles about a hip joint of the person utilizing the machine, said means for providing an aerobic level of resistance to said moveable arm member including means for converting forward and reverse movement of said moveable arm member to continuous cyclical movement, said means for converting said movement including a connecting rod connected between a point on said moveable arm member and a non-axis point of a rotatable drive device, said rotatable drive device being connected to energy storage means whereby energy may be stored and released, said energy storage means storing energy during forward and reverse movements of said moveable arm member and releasing energy during the transition from forward to reverse and vice versa.

8. An aerobic exercise machine in accordance with claim 7 including an adjustable foot rest mounted at a level below said seat.

9. An aerobic exercise machine in accordance with claim 7 including means for adjusting the position of the chest contact means on the moveable arm.

10. An aerobic exercise machine in accordance with claim 7 wherein a lower end of said moveable arm member is connected to a generator through a drive assembly.

11. An aerobic exercise machine in accordance with claim 10 wherein said drive assembly is adjustable to adjust a range of motion of said moveable arm member.

12. An aerobic exercise machine in accordance with claim 10 wherein said means for providing an aerobic level of resistance provides a substantially uniform level of resistance throughout a range of motion of said moveable arm member.

13. An aerobic exercise machine in accordance with claim 12 wherein said means for providing an aerobic level of resistance which provides a substantially uniform level of resistance throughout the range of motion of said moveable arm member includes an energy storage device in the form of a flywheel.

14. An aerobic exercise machine in accordance with claim 12 including means for selecting preselected amounts of electrical resistance for connection across said generator.

15. An aerobic exercise machine in accordance with claim 10 including a switch actuated by said drive assembly and a counter connected to said switch for counting movements of said moveable arm member.

16. An aerobic exercise machine in accordance with claim 7 including a counter weight mounted on said moveable arm member below its pivotal mount.

17. An aerobic exercise machine in accordance with claim 7 including means for adjusting relative position of said means for contacting the chest and said means for contacting the upper back of the person utilizing the machine such that an adjustment may be made whereby the chest is substantially in contact with said means for contacting the chest and simultaneously the upper back is substantially in contact with said means for contacting the upper back of the person.

18. A machine, comprising a seat;

an arm including means for contacting the anterior and posterior surfaces of the trunk of a person when seated on said seat;

said arm being pivotally mounted and adapted to enable flexion and extension of the hip of an exerciser seated in said seat;

means for enabling the selection of a predetermined level of resistance opposing movement of said arm to enable said exerciser to flex and extend the hip continuously for an extended duration of time of at least fifteen minutes whereby the exerciser may aerobically exercise flexor and extensor muscles of the trunk and hip region, said means for enabling the selection of a predetermined level of resistance opposing movement of said arm including a generator, a switch and several values of electrical resistance which are switchable to provide differing loads to said generator; and energy storage means mechanically coupled to said generator for providing uniform resistance opposing movement of said arm.

19. A machine in accordance with claim 18 which includes means for providing a substantially uniform level of resistance to movement to said arm in the form of an energy storage device.

20. A machine in accordance with claim 19 wherein said energy storage device is a flywheel.

21. A machine in accordance with claim 18 wherein said pivotally mounted arm is mounted to pivot about a point adapted to substantially coincide with a pivot axis of hips of an exerciser when seated on said seat.

22. A machine in accordance with claim 18 including means for adjusting relative position of said means for contacting the anterior and posterior surface of the trunk of the person such that said contacting means is simultaneously substantially in contact with the anterior and posterior surfaces of the trunk of a person.

23. A method of providing aerobic exercise, comprising:

providing a machine to enable continuous flexion and extension at the hip of a person;

providing, as a part of said machine, an arm pivoted substantially at the location of a hip of a person exercising, and providing anterior and posterior contacts connected to said arm for substantially maintaining contact with the chest and back of an exerciser;

providing a selected level of resistance to movement to said arm to enable said exerciser to continuously perform flexion and extension at the hip of the exerciser for a period of at least fifteen minutes duration; and providing an energy storage device wherein energy is stored during performance of flexion and extension and is released to reduce the level of resistance to movement of said arm when going from flexion to extension or vice versa.

24. A method in accordance with claim 23 wherein said method includes the step of providing a uniform resistance to movement to said arm throughout the flexion and extension portion of the exercise.

* * * * *